US007907046B2

(12) United States Patent
Tsukada

(10) Patent No.: US 7,907,046 B2
(45) Date of Patent: Mar. 15, 2011

(54) CHIP RESISTOR AND METHOD FOR PRODUCING THE SAME

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 493 days.

(21) Appl. No.: 11/991,513

(22) PCT Filed: Sep. 4, 2006

(86) PCT No.: PCT/JP2006/317434

§ 371 (c)(1),
(2), (4) Date: Mar. 5, 2008

(87) PCT Pub. No.: WO2007/029635

PCT Pub. Date: Mar. 15, 2007

(65) Prior Publication Data

US 2009/0115568 A1 May 7, 2009

(30) Foreign Application Priority Data

Sep. 6, 2005 (JP) ..... 2005-258209

(51) Int. Cl.
*H01C 1/012* (2006.01)

(52) U.S. Cl. ..... 338/309; 338/307; 29/621

(58) Field of Classification Search ..... 338/307–309; 29/610, 621

See application file for complete search history.

(56) References Cited

U.S. PATENT DOCUMENTS

| | | | | |
|---|---|---|---|---|
| 5,334,968 | A * | 8/1994 | Negoro | 338/320 |
| 5,990,781 | A * | 11/1999 | Kambara | 338/309 |
| 6,153,256 | A | 11/2000 | Kambara et al. | |
| 6,636,143 | B1 * | 10/2003 | Hashimoto et al. | 338/309 |
| 6,727,111 | B2 * | 4/2004 | Tsukada | 438/33 |
| 7,237,324 | B2 * | 7/2007 | Matsukawa et al. | 29/621 |

FOREIGN PATENT DOCUMENTS

| | | |
|---|---|---|
| JP | 9-63805 | 3/1997 |
| JP | 2000-133507 | 5/2000 |

OTHER PUBLICATIONS

International Search Report from the corresponding PCT/JP2006/317434, mailed Nov. 6, 2006.

* cited by examiner

*Primary Examiner* — Kyung Lee
(74) *Attorney, Agent, or Firm* — Hamre, Schumann, Mueller & Larson, P.C.

(57) ABSTRACT

The chip resistor (1) of the present invention includes an insulating substrate (2) in the form of a chip, a pair of terminal electrodes (3, 4) formed on both ends of the insulating substrate (2), a plurality of resistor films (5) formed on an obverse surface of the insulating substrate (2) in parallel with each other between the paired terminal electrodes (3, 4), and a cover coat formed on the obverse surface of the insulating substrate (2) to cover the resistor films (5). In the chip resistor (1), one of the terminal electrodes (3) includes individual upper electrodes (8) each formed on the obverse surface of the insulating substrate (3, 4) to be independently connected to a respective one of the resistor films (5) and a side electrode (9) formed on a side surface of the insulating substrate (2) to be connected to all the individual upper electrodes (8).

4 Claims, 10 Drawing Sheets

CHIP RESISTOR AND METHOD FOR PRODUCING THE SAME

TECHNICAL FIELD

The present invention relates to a chip resistor including a chip-shaped insulating substrate and a resistor film provided on the substrate, and it also relates to a method for manufacturing such a chip resistor.

BACKGROUND ART

As disclosed in Patent Document 1, a conventional chip resistor of the above-mentioned type includes a pair of terminal electrodes provided on both ends of an insulating substrate chip. The upper surface of the insulating substrate is formed with a resistor film electrically connected to the paired terminal electrodes. The chip resistor may be mounted on a printed circuit board by soldering.

Patent Document 1: JP-A-2000-133507

When the voltage of a power source is supplied to the printed circuit board carrying the chip resistor, the voltage is to be applied between the paired terminal electrodes. Since the single resistor film is provided between the paired terminal electrodes, all the power supplied between the electrodes concentrates on the resistor film. The concentration of the power on the resistor film increases the temperature of the resistor film. Accordingly, it is unpractical to use the chip resistor for a high-power circuit.

One way to address the above problem may be to arrange a plurality of resistor films in parallel on the upper surface of the insulating substrate between the paired terminal electrodes. With this arrangement, the power supplied between the paired terminal electrodes is divided into each resistor film. Hence, the temperature increase in the respective resistor films is suppressed, so that the chip resistor is applicable to a circuit to which high power is to be supplied.

The resistor film of a chip resistor is formed with a trimming groove. By forming a trimming groove, the resistance between the paired terminal electrodes is set to be within a predetermined allowable range.

In a chip resistor in which a plurality of resistor films are arranged in parallel between the paired terminal electrodes, each of the resistor films is electrically connected to the terminal electrodes. Thus, it is extremely difficult to make the dimensions of the trimming grooves of all the resistor films equal or substantially equal to each other. In other words, it is difficult to make the resistances of all the resistor films equal or substantially equal to each other. As a result, excessive temperature increase may occur at some of the resistor films which have a relatively high resistance.

DISCLOSURE OF THE INVENTION

An object of the present invention, which is proposed under the above-described circumstances, is to provide a chip resistor which is capable of suppressing temperature increase at some of the resistor films and a method for manufacturing such a chip resistor.

According to a first aspect of the present invention, there is provided a chip resistor comprising: an insulating substrate in the form of a chip; a pair of terminal electrodes formed on both ends of the insulating substrate; a plurality of resistor films formed on an obverse surface of the insulating substrate in parallel with each other between the paired terminal electrodes; and a cover coat formed on the obverse surface of the insulating substrate to cover the resistor films. One of the paired terminal electrodes comprises individual upper electrodes each formed on the obverse surface of the insulating substrate to be independently connected to a respective one of the resistor films and a side electrode formed on a side surface of the insulating substrate to be connected to all the individual upper electrodes.

Preferably, the other one of the paired terminal electrodes comprises individual upper electrodes each formed on the obverse surface of the insulating substrate to be independently connected to a respective one of the resistor films and a side electrode formed on the other side surface of the insulating substrate to be connected to all the individual upper electrodes.

Preferably, the chip resistor further comprises an auxiliary upper electrode formed on each of the individual upper electrodes to cover the individual upper electrode. Part of the auxiliary upper electrode overlaps an end of the cover coat.

Preferably, the other one of the paired terminal electrodes comprises a common upper electrode formed on the obverse surface of the insulating substrate to be connected to all the resistor films and a side electrode formed on the other side surface of the insulating substrate to be connected to the common upper electrode.

Preferably, the chip resistor further comprises auxiliary upper electrodes formed on the individual upper electrodes and the common upper electrode to cover the individual upper electrodes and the common upper electrode. Part of the auxiliary upper electrodes overlaps ends of the cover coat.

According to a second aspect of the present invention, there is provided a method for manufacturing a chip resistor. The method comprises the steps of forming, on an obverse surface of an insulating substrate in the form of a chip, a plurality of resistor films in parallel with each other and individual upper electrodes independently connected to both ends of each of the resistor films, forming a trimming groove for resistance adjustment in each of the resistor films, forming a cover coat for covering the resistor films on the obverse surface of the insulating substrate, and forming side electrodes on opposite side surfaces of the insulating substrate to be connected to all the individual upper electrodes.

Preferably, the method further comprises the step of forming, after the cover coat formation step, an auxiliary upper electrode on each of the individual upper electrodes to cover the individual upper electrode so that part of the auxiliary upper electrode overlaps an end of the cover coat.

According to a third aspect of the present invention, there is provided a method for manufacturing a chip resistor. The method comprises the steps of forming, on an obverse surface of an insulating substrate in the form of a chip, a plurality of resistor films in parallel with each other, individual upper electrodes each independently connected to a first end of a respective one of the resistor films and a common upper electrode commonly connected to respective second ends of the resistor films, forming a trimming groove for resistance adjustment in each of the resistor films, forming a cover coat for covering the resistor films on the obverse surface of the insulating substrate, forming a side electrode on a side surface of the insulating substrate to be connected to all the individual upper electrodes, and forming a side electrode on the other side surface of the insulating substrate to be connected to the common upper electrode.

Preferably, the method further comprises the step of forming, after the cover coat formation step, auxiliary upper electrodes on the individual upper electrodes and the common upper electrode to cover the individual upper electrodes and the common upper electrode so that part of the auxiliary upper electrodes overlaps ends of the cover coat.

BEST MODE FOR CARRYING OUT THE INVENTION

Preferred embodiments of the present invention will be described below with reference to the accompanying drawings. It is to be noted that the same or similar elements are designated by the same reference signs throughout the figures.

Figure 1:
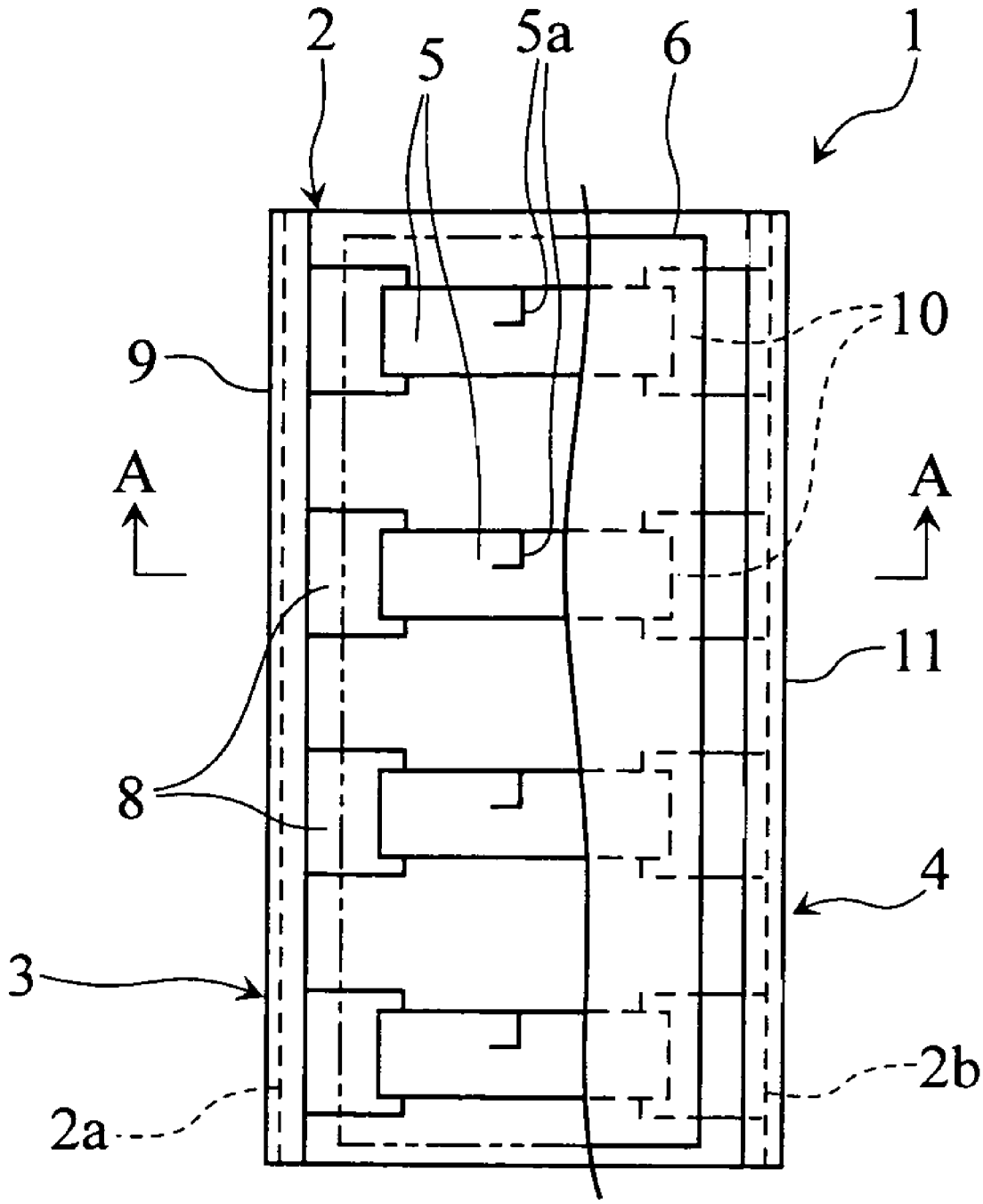
FIG. 1 is a plan view partially cut away, showing a chip resistor according to a first embodiment of the present invention.
Figure 2:
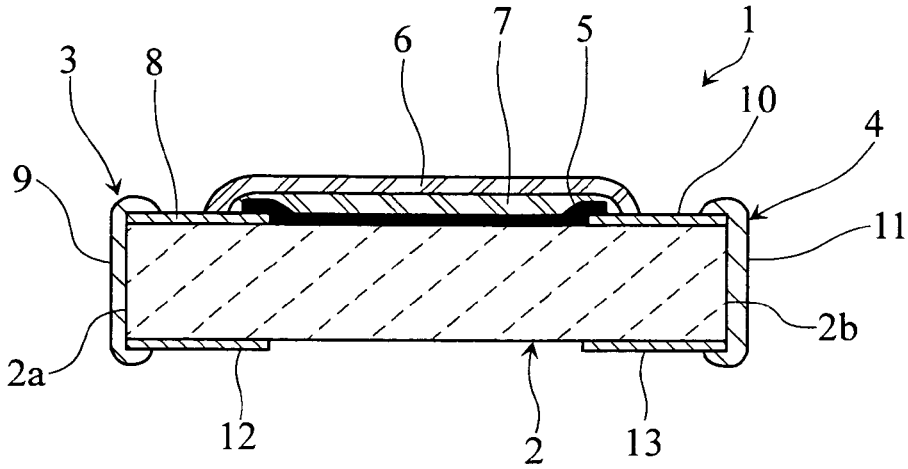
FIG. 2 is a sectional view taken along lines A-A in FIG. 1.

FIGS. 1 and 2 show a chip resistor 1 according to a first embodiment of the present invention.

The chip resistor 1 includes an insulating substrate 2 which is made of a heat-resistant material such as a ceramic material and generally in the form of an elongated rectangle in plan view, a pair of terminal electrodes 3,4 formed at widthwise ends of the insulating substrate 2, a plurality of resistor films 5 arranged on an obverse surface of the insulating substrate 2 in parallel with each other in the longitudinal direction of the insulating substrate 2, and a cover coat 6 formed on the obverse surface of the insulating substrate 2 to cover the resistor films 5.

When the chip resistor 1 is mounted on a non-illustrated printed circuit board, the terminal electrodes 3, 4 are connected by soldering to a circuit pattern (not shown) of the printed circuit board.

The cover coat 6 is made of glass or a heat-resistant synthetic resin. An undercoat 7 made of glass and covering each of the resistor films 5 individually is provided under the cover coat 6. In FIG. 1, the illustration of the undercoat 7 is omitted.

The terminal electrode 3 includes individual upper electrodes 8 and a side electrode 9. Each of the individual upper electrodes 8 is formed on the upper surface of the insulating substrate 2 to be electrically connected individually to an end of a respective resistor film 5. The individual upper electrodes 8 are made of silver-based conductive paste. The side electrode 9 is formed on a longitudinal side surface 2*a* of the insulating substrate 2 to be electrically connected to all the individual upper electrodes 8.

The terminal electrode 4 includes individual upper electrodes 10 and a side electrode 11. Each of the individual upper electrodes 10 is formed on the upper surface of the insulating substrate 2 to be electrically connected individually to an end of a respective resistor film 5. The individual upper electrodes 10 are made of silver-based conductive paste. The side electrode 11 is formed on a longitudinal side surface 2*b* of the insulating substrate 2 to be electrically connected to all the individual upper electrodes 10.

Lower electrodes 12 and 13 are provided on the lower surface of the insulating substrate 2 independently with respect to each of the resistor films 5. Alternatively, the lower electrodes 12 and 13 may be provided to be common to all the resistor films 5. The lower electrode 12 is connected to the side electrode 9 along the longitudinal side surface 2*a* of the insulating substrate 2. The lower electrode 13 is electrically connected to the side electrode 11 along the longitudinal side surface 2*b* of the insulating substrate 2.

Though not illustrated, a solder plating layer is formed, via a nickel plating layer as an underlayer, on the surfaces of the individual upper electrodes 8, 10, side electrodes 9, 11 and lower electrodes 12, 13. The nickel plating layer may be omitted.

A method for manufacturing the chip resistor 1 will be described below.

Figure 3:
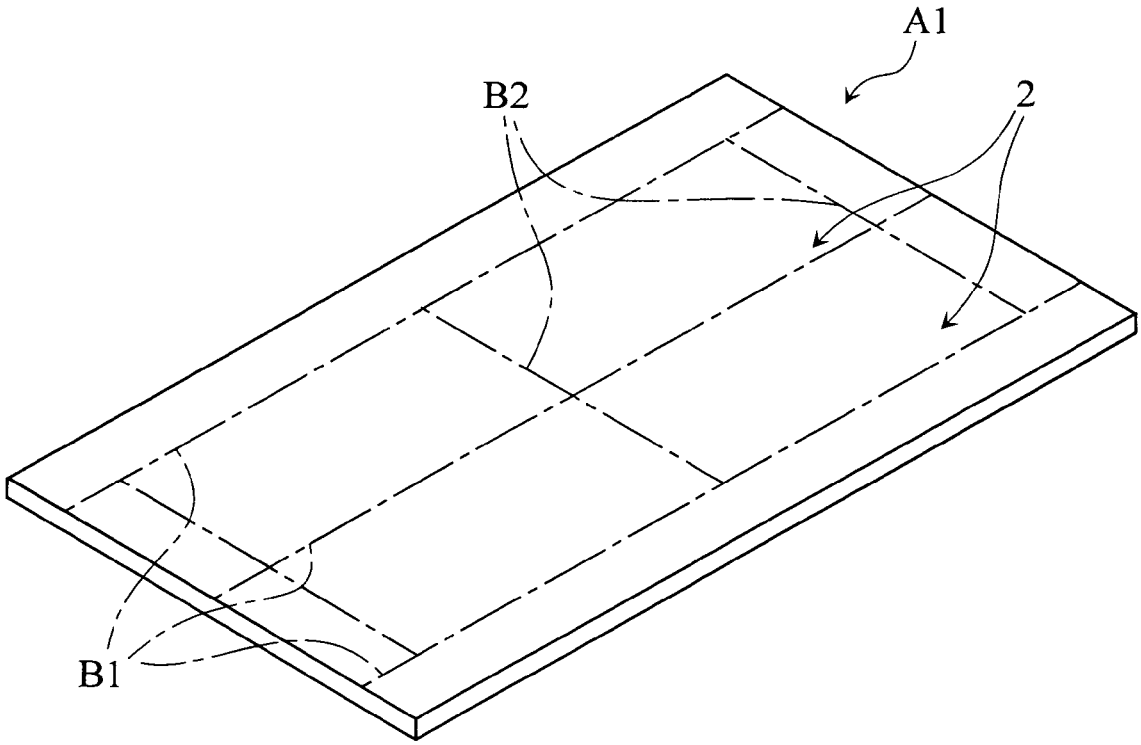
FIG. 3 shows a process for manufacturing the chip resistor according to the first embodiment.

First, as shown in FIG. 3, a material board Al is prepared which integrally includes a plurality of insulating substrates 2 arranged in rows and columns.

The material board A1 is later to be divided by breaking or dicing along the division lines B1 in the longitudinal direction and the division lines B2 in the widthwise direction into a plurality of insulating substrates 2, which will be described later.

Figure 4:
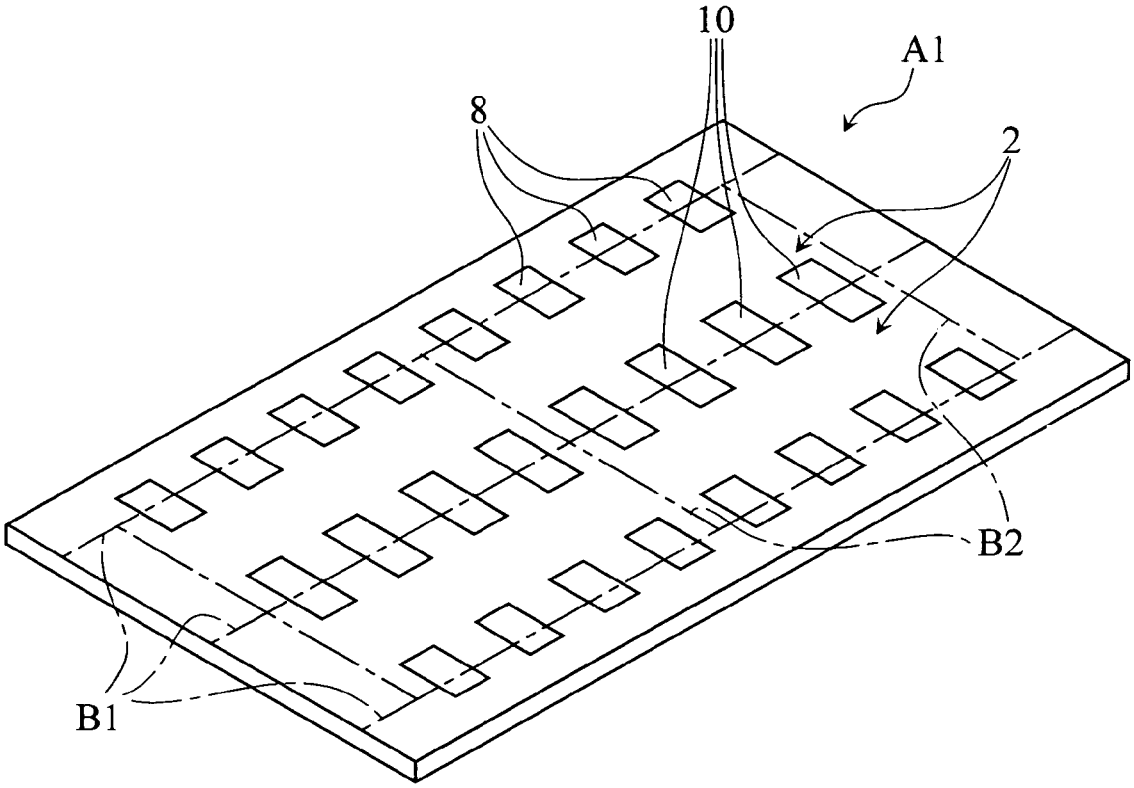
FIG. 4 shows a process for manufacturing the chip resistor according to the first embodiment.

Then, as shown in FIG. 4, individual upper electrodes 8 and 10 are formed on the upper surface of the material board A1 at appropriate portions in each of the insulating substrates 2 by the application of a metal-based conductive paste such as silver-based paste by screen printing and the subsequent baking. Similarly, lower electrodes 12 and 13 (not shown) are formed on the lower surface of the material board Al at appropriate portions in each of the insulating substrates 2 by the application of a metal-based conductive paste such as silver-based paste by screen printing and the subsequent baking.

Figure 5:
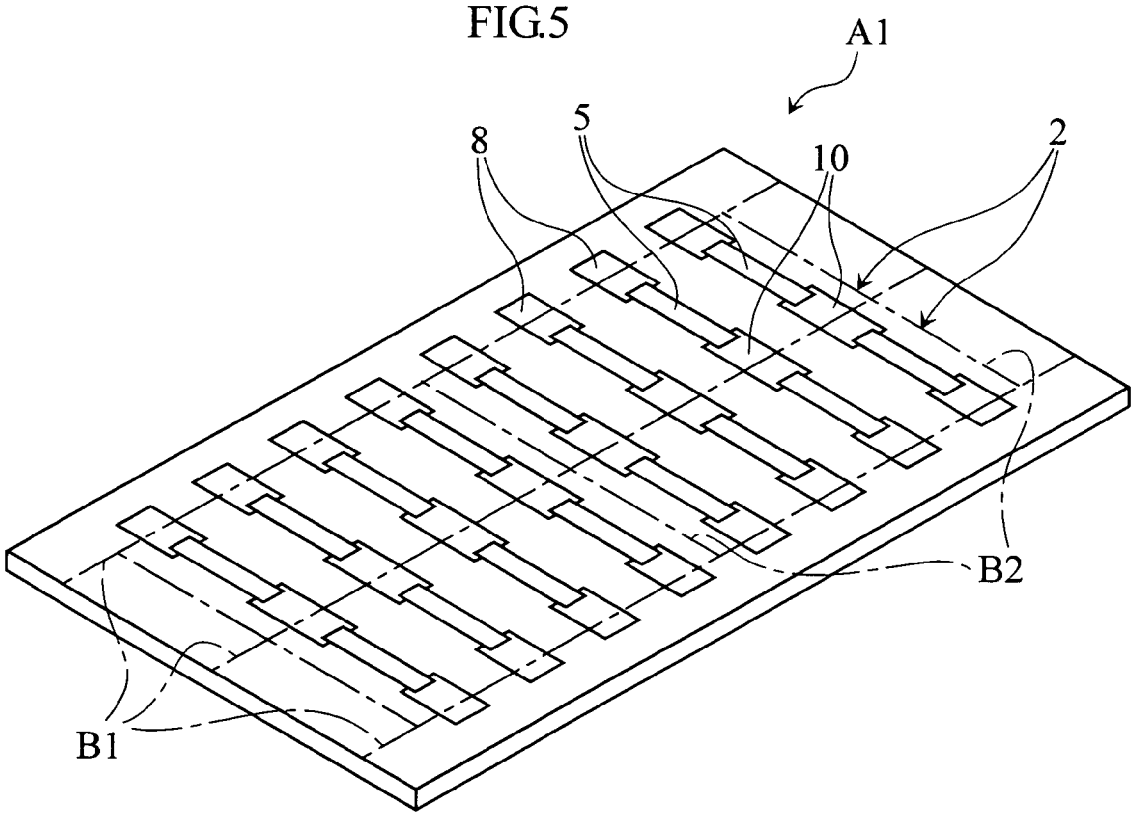
FIG. 5 shows a process for manufacturing the chip resistor according to the first embodiment.

Then, as shown in FIG. 5, a plurality of resistor films 5 are formed on the upper surface of the material board A1 at appropriate portions in each of the insulating substrates 2 by the application of material paste by screen printing and the subsequent baking.

Unlike the above, the resistor films 5 may be formed before the individual upper electrodes 8 and 10 are formed.

Figure 6:
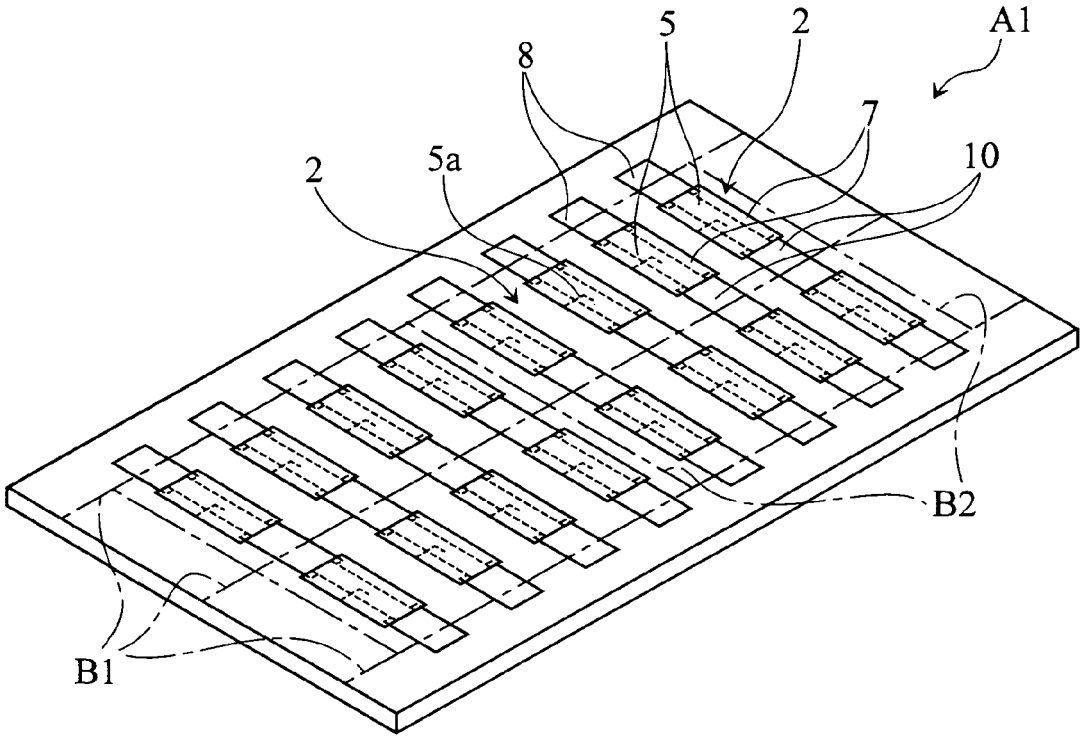
FIG. 6 shows a process for manufacturing the chip resistor according to the first embodiment.

Then, as shown in FIG. 6, an undercoat 7 of glass is formed on each of the resistor films 5 by the application of material paste by screen printing and the subsequent baking. Then, the total resistance between the paired terminal electrodes 3, 4 (see FIGS. 1 and 2) is so adjusted as to lie within a predetermined allowable range. The resistance adjustment is performed by forming a trimming groove 5*a* in each of the resistor films 5. Specifically, with probes for energization held in contact with the individual upper electrodes 8 and 10, the trimming groove 5*a* is formed to have an appropriate dimension while measuring the resistance of the resistor film 5.

In this way, in this method for manufacturing the chip resistor 1, the trimming groove 5*a* is formed in each of the resistor films 5 before the side electrodes 9, 11 are formed. Since each of the resistor films 5 and the individual upper electrodes 8, 10 on the ends thereof are independent from others, the formation of the trimming groove 5*a* is properly performed individually with respect to each of the resistor films 5 while measuring the resistance of the resistor film 5.

Thus, it is possible to make the dimensions of the trimming grooves 5*a* of all the resistor films 5 be equal or substantially equal to each other. That is, it is easy to make the resistances of the resistor films 5 be equal or substantially equal to each other.

Figure 7:
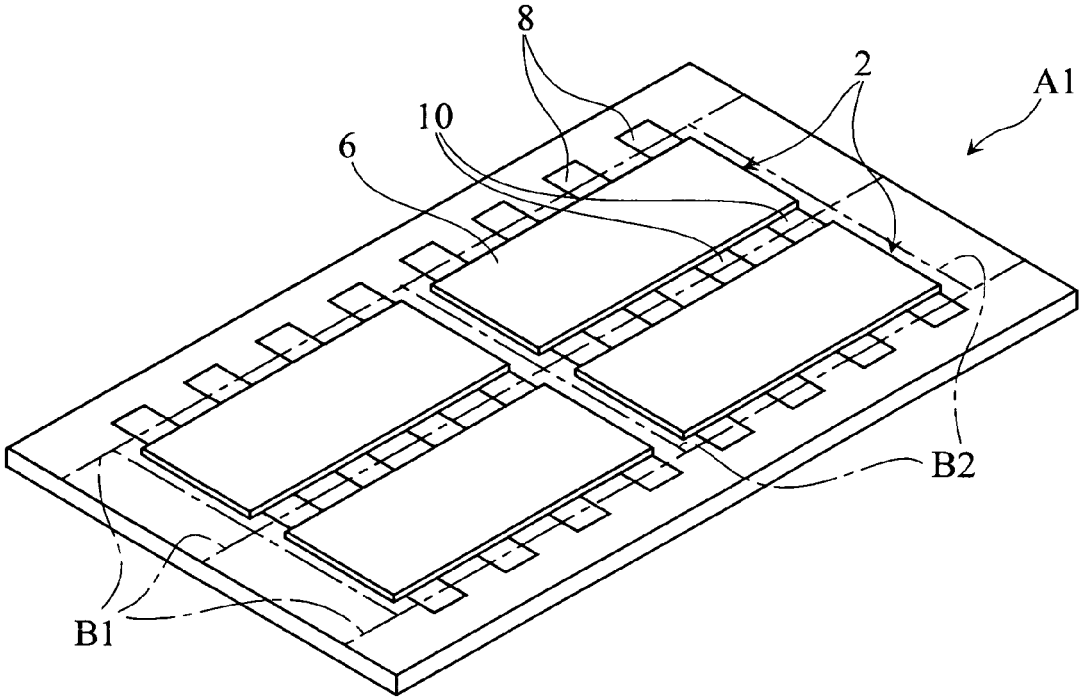
FIG. 7 shows a process for manufacturing the chip resistor according to the first embodiment.

Then, as shown in FIG. 7, cover coats 6 are formed on the upper surface of the material board A1 at an appropriate portion in each of the insulating substrates 2. Specifically, when glass is used as the material, the cover coat is formed by the application of glass paste by screen printing and the subsequent baking. When a synthetic resin is used as the material, the cover coat 6 is formed by the application of the synthetic resin paste by screen printing and the subsequent drying.

Figure 8:
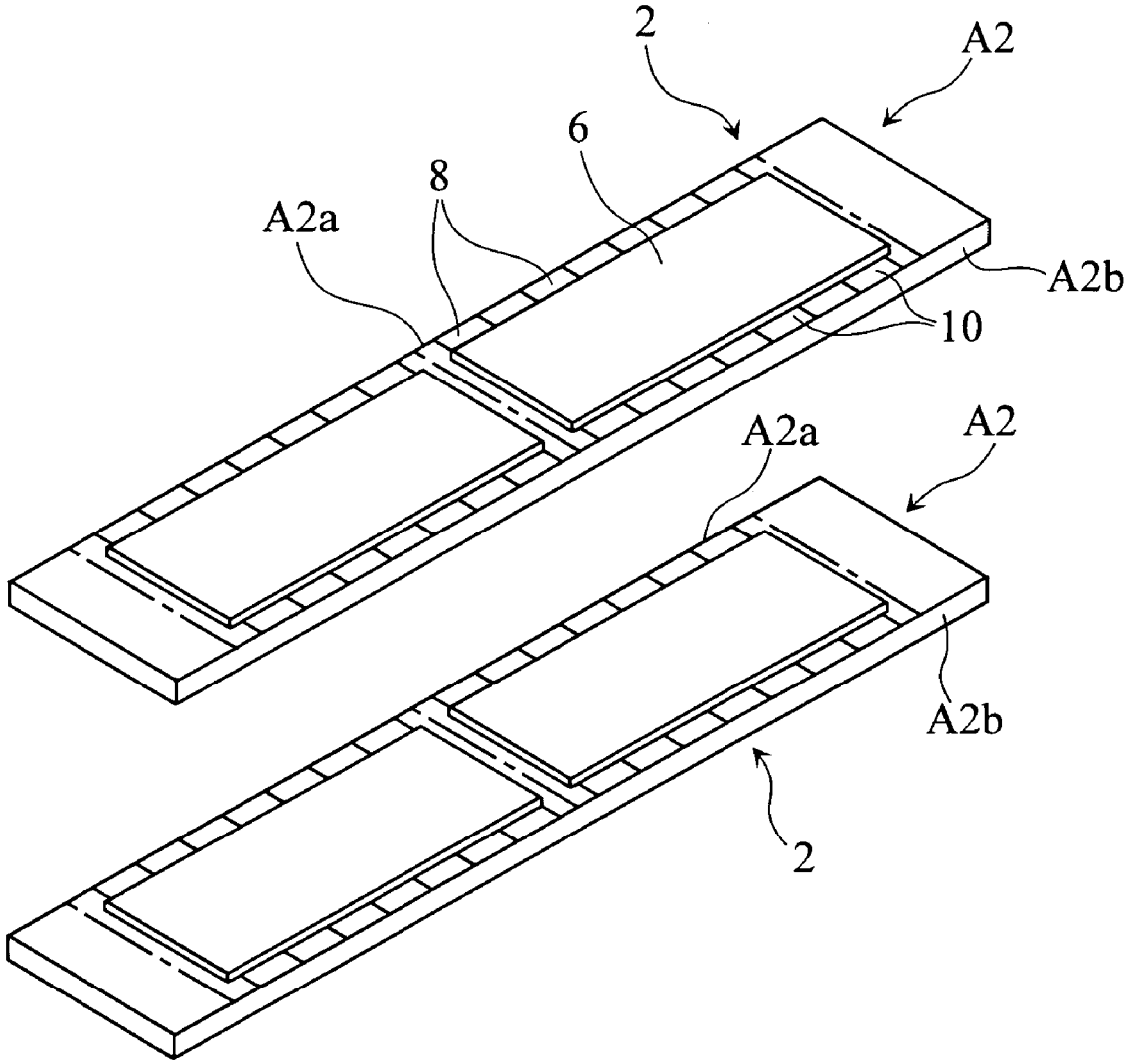
FIG. 8 shows a process for manufacturing the chip resistor according to the first embodiment.

Then, as shown in FIG. 8, the material board A1 is divided along the division lines B1 in the longitudinal direction into material boards A2 in the form of a bar.

Figure 9:
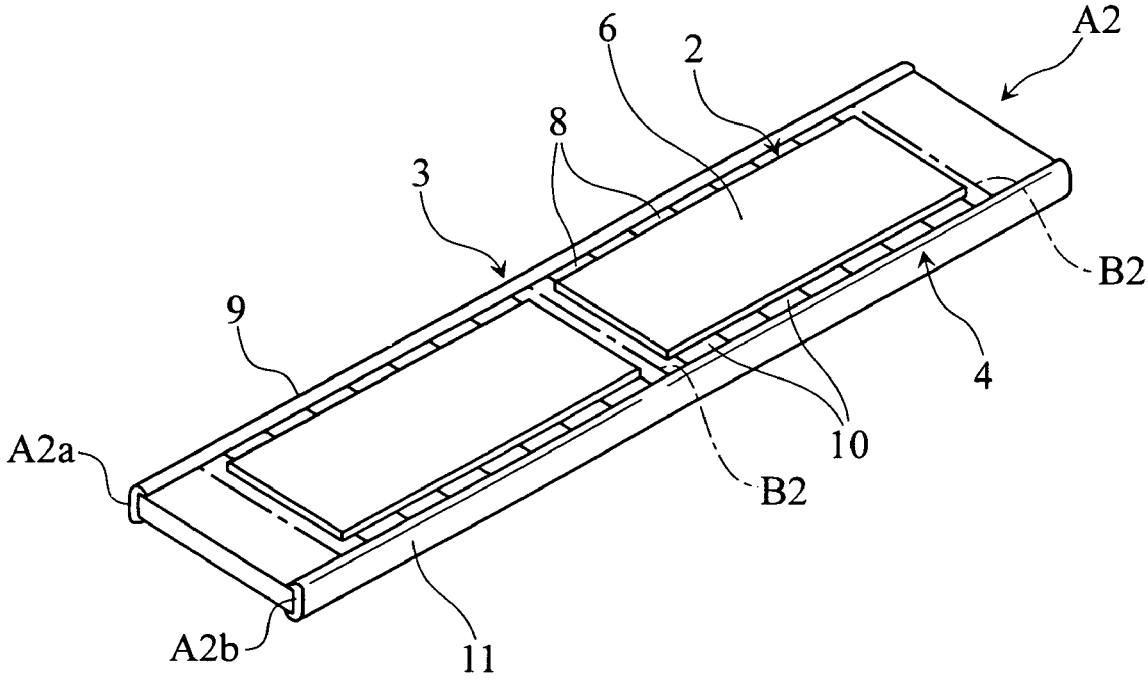
FIG. 9 shows a process for manufacturing the chip resistor according to the first embodiment.

Then, as shown in FIG. 9, side electrodes 9, 11 are formed on opposite side surfaces A2*a*, A2*b* of the bar-shaped material board A2. Specifically, when metal-based conductive paste is used as the material, the side electrodes are formed by the application of the material paste by screen printing and the subsequent baking. When nonmetal-based conductive paste is used as the material, the side electrodes 9, 11 are formed by the application of the material paste by screen printing and the subsequent drying.

Figure 10:
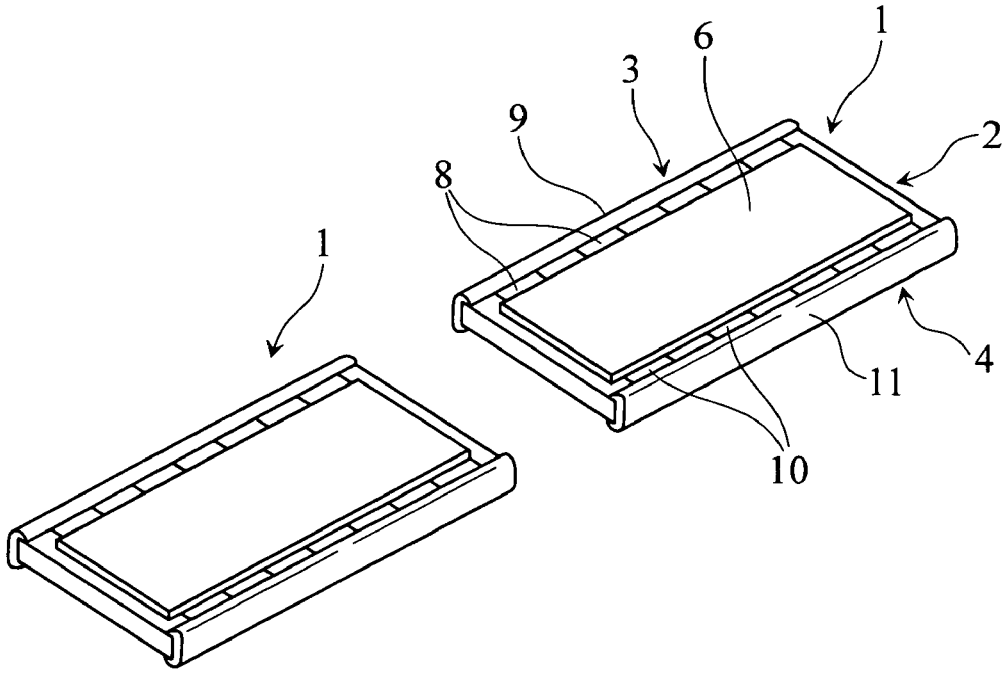
FIG. 10 shows a process for manufacturing the chip resistor according to the first embodiment.

Then, as shown in FIG. 10, the bar-shaped material board A2 is divided along the division line B2 in the widthwise direction into insulating substrates 2. Then, plating such as barrel plating is performed. Thus, the chip resistor 1 is obtained.

As noted above, in making the chip resistor 1, the trimming groove 5*a* is formed in each of the resistor films 5 before the side electrodes 9, 11 are formed. Since each of the resistor films 5 and the individual upper electrodes 8, 10 on the ends thereof are independent from others, the formation of the trimming groove 5*a* is properly performed individually with respect to each of the resistor films 5 while measuring the resistance of the resistor film 5. Thus, it is possible to make the resistances of all the resistor films 5 be equal or substantially equal to each other, so that excessive temperature rise at any of the resistor films 5 is prevented.

Figure 11:
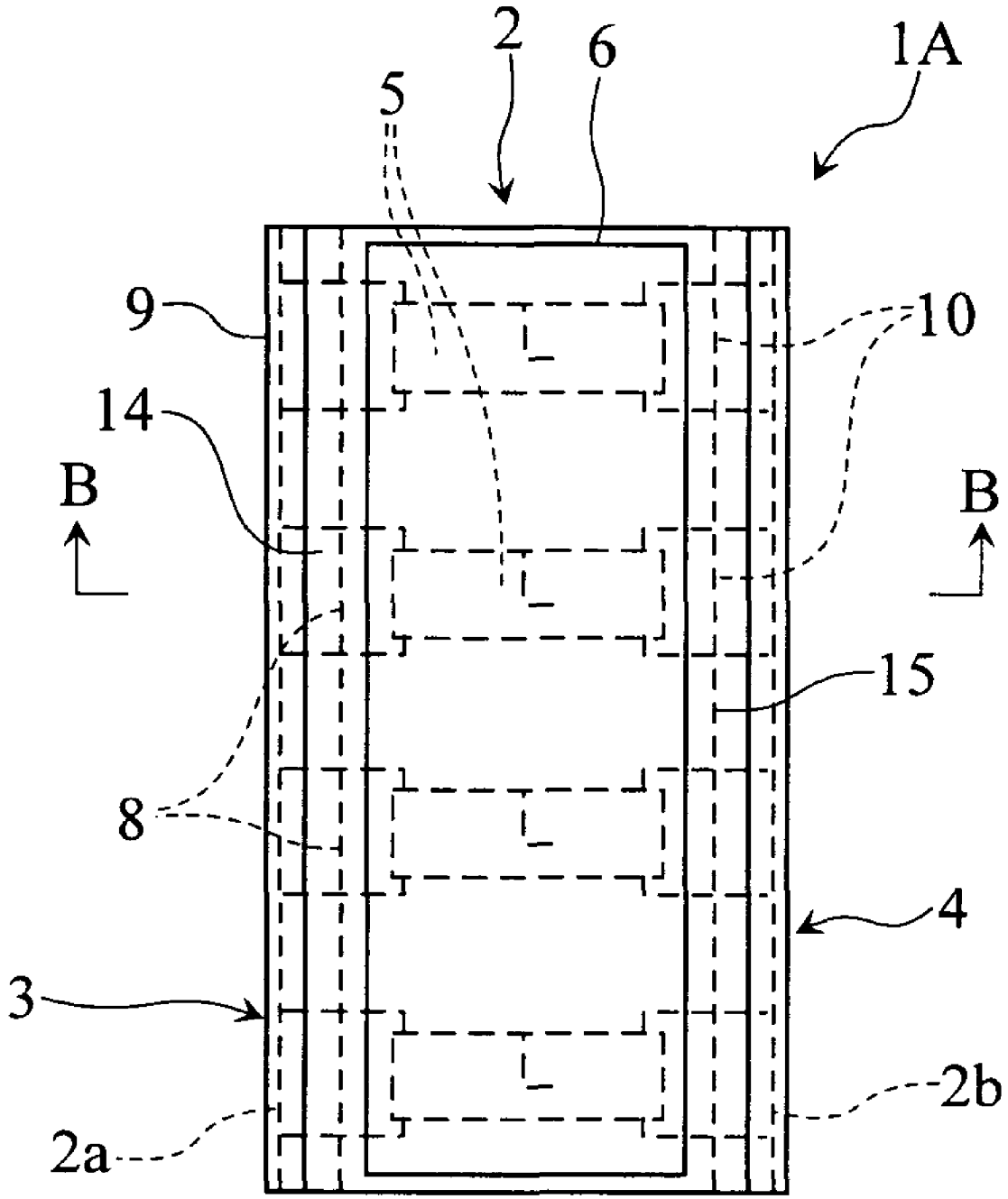
FIG. 11 is a plan view showing a chip resistor according to a second embodiment of the present invention.
Figure 12:
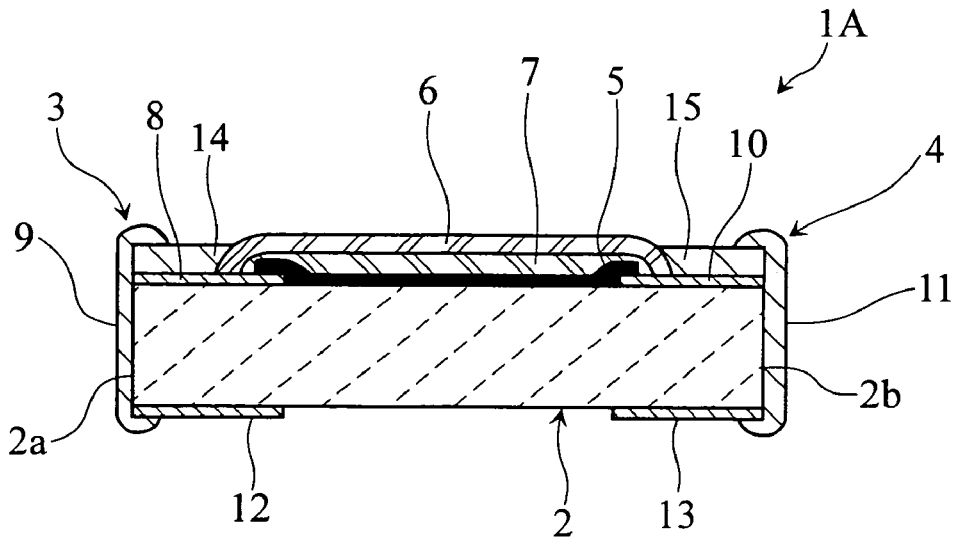
FIG. 12 is a sectional view taken along lines B-B in FIG. 11.

FIGS. 11 and 12 show a chip resistor 1A according to a second embodiment of the present invention.

The chip resistor 1A differs from the chip resistor 1 of the first embodiment in that auxiliary upper electrodes 14, 15 for covering the individual upper electrodes 8, 10 on the insulating substrate 2 are formed on the individual upper electrodes 8, 10. The auxiliary upper electrodes 14, 15 partially overlap the ends of the cover coat 6. The auxiliary upper electrodes 14 and 15 are electrically connected to the side electrodes 9 and 10, respectively. The structure of other parts is the same as that of the first embodiment. The auxiliary upper electrodes 14, 15 may be provided individually for each pair of the individual upper electrodes 8, 10 or may be so formed as to extend continuously over all the individual upper electrodes 8, 10.

When the individual upper electrodes 8, 10 are made of silver-based conductive paste having a low resistivity, the auxiliary upper electrodes 14, 15 reliably prevent the corrosion such as migration of the individual upper electrodes 8, 10 due to sulfur components in the air. The auxiliary upper electrodes 14, 15 eliminate or reduce the stepped portion formed between the upper surface of the terminal electrode 3, 4 and the upper surface of the cover coat 6. Further, the provision of the auxiliary upper electrodes 14, 15 reduces the resistance between the terminal electrodes 3, 4.

To manufacture the chip resistor 1A of the second embodiment, after the cover coat 6 is formed (see FIG. 7), auxiliary upper electrodes 14, 15 are formed on the upper surface of the material board Al to cover the upper surfaces of the individual upper electrodes 8, 10. The auxiliary upper electrodes may be formed by the application of metal-based conductive paste by screen printing and the subsequent baking. When nonmetal-based conductive paste is used as the material, the auxiliary upper electrodes 14, 15 may be formed by the application of the material paste by screen printing and the subsequent drying. Thereafter, as shown in FIG. 8, the material board A1 is divided along the division lines B1 in the longitudinal direction into bar-shaped material boards A2.

Figure 13:
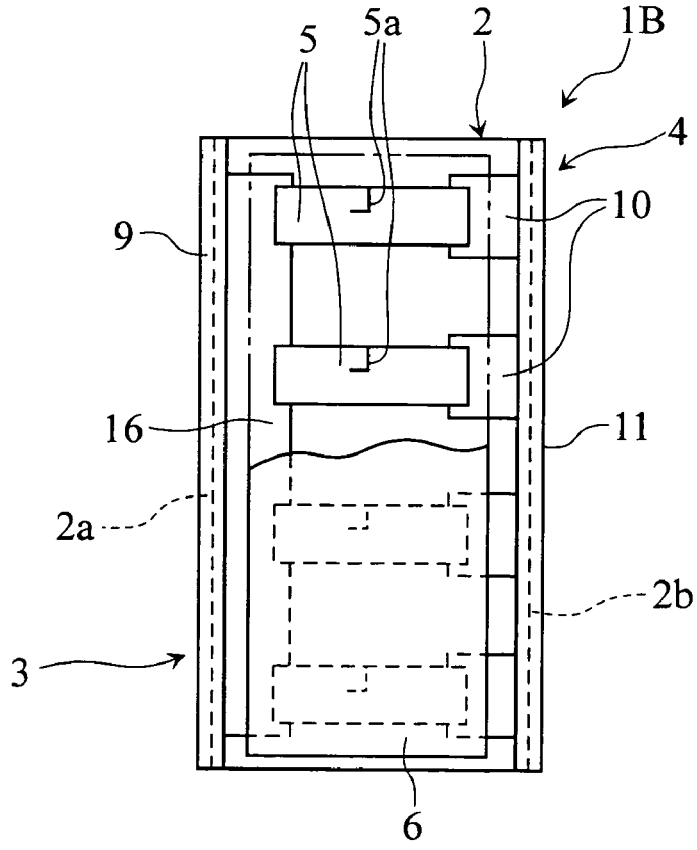
FIG. 13 is a plan view partially cut away, showing a chip resistor according to a third embodiment of the present invention.

FIG. 13 shows a chip resistor 1B according to a third embodiment of the present invention.

The chip resistor 1B of the third embodiment differs from that of the first embodiment in that a common upper electrode 16 electrically connected to all the resistor films 5 is provided on the insulating substrate 2 instead of the individual upper electrodes 8 of the terminal electrode 3. The structure of other parts is the same as that of the first embodiment. With this structure again, the same advantages as those of the first embodiment are obtained.

Figure 14:
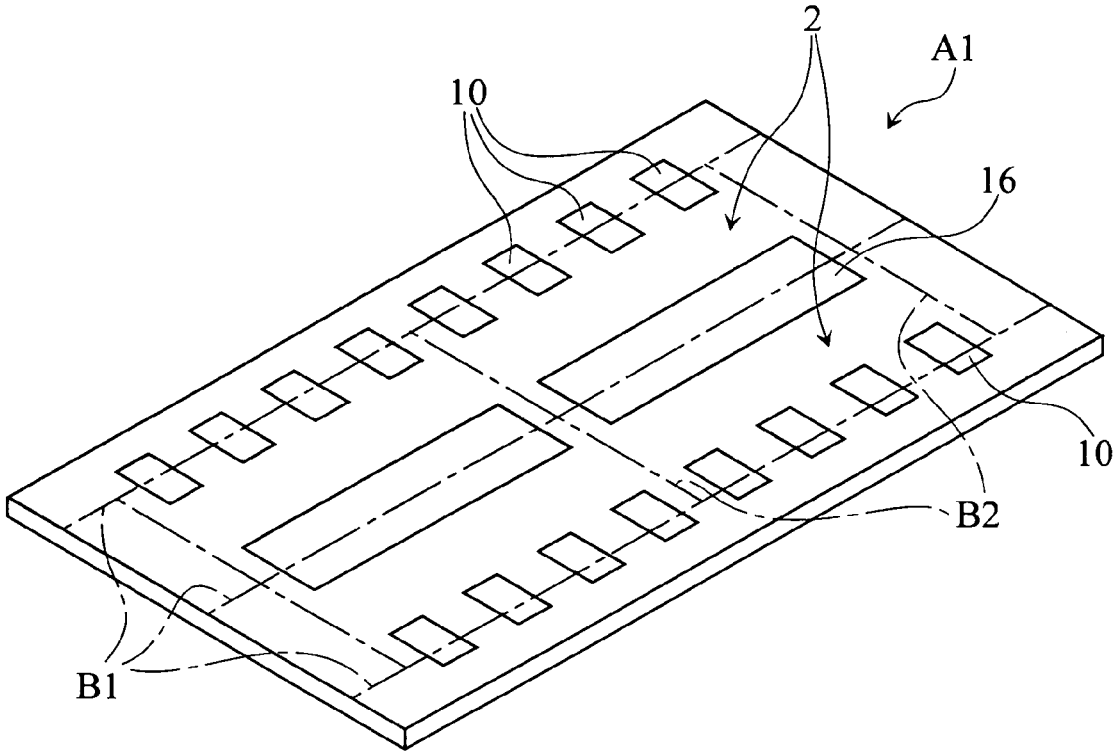
FIG. 14 shows a process for manufacturing the chip resistor according to the third embodiment.

To manufacture the chip resistor 1B of the third embodiment, as shown in FIG. 14, the individual upper electrodes 10 and the common upper electrodes 16 are formed on the material board A1 at appropriate portions in each of the insulating substrates 2 by the application of metal-based conductive paste such as silver-based paste by screen printing and the subsequent baking.

Figure 15:
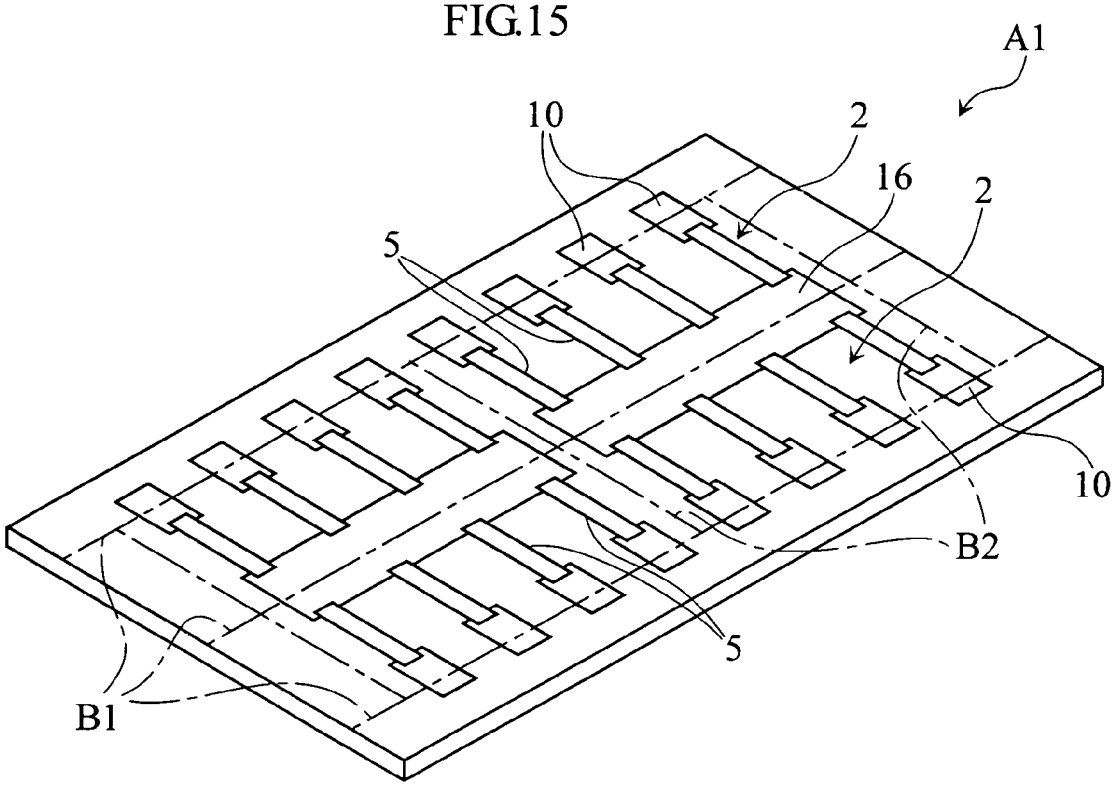
FIG. 15 shows a process for manufacturing the chip resistor according to the third embodiment of the present invention.

Then, as shown in FIG. 15, a plurality of resistor films 5 are formed at appropriate portions in each of the insulating substrates 2 by the application of material paste by screen printing and the subsequent baking so that each of the individual upper electrodes 10 and the common upper electrode 16 are connected to each other. The subsequent steps are the same as those of the manufacturing process of the first embodiment.

Figure 16:
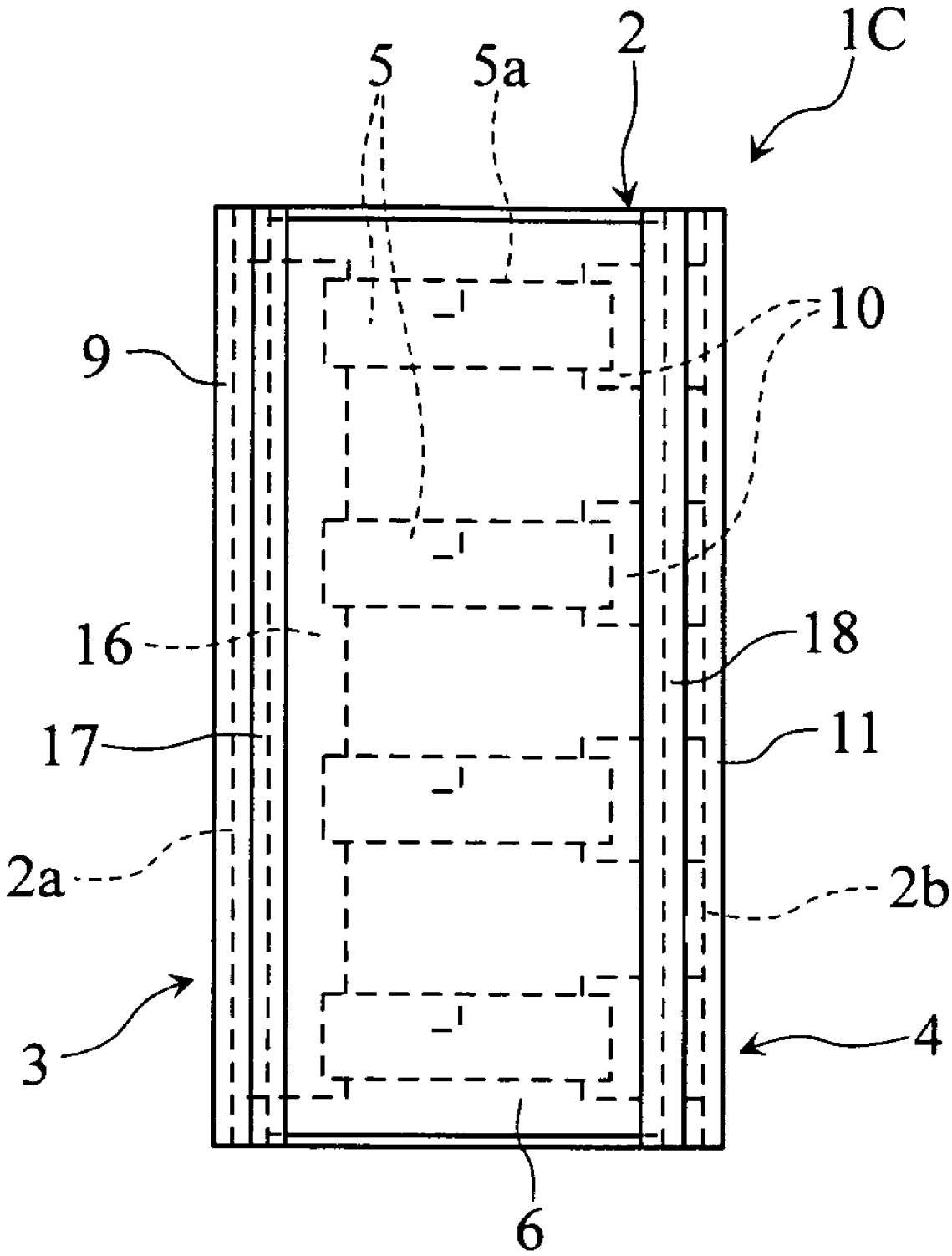
FIG. 16 is a plan view showing a chip resistor according to a fourth embodiment of the present invention.

FIG. 16 shows a chip resistor 1C according to a fourth embodiment of the present invention.

The chip resistor 1C includes auxiliary upper electrodes 17 and 18 formed to cover the common upper electrode 16 and the individual upper electrodes 10 on the insulating substrate 2. The structure of other parts is the same as that of the third embodiment. The auxiliary upper electrode 18 may be provided individually for each of the individual upper electrodes 10 or may be so formed as to extend continuously over all the individual upper electrodes 10. With this structure again, the same advantages as those of the third embodiment are obtained.

The present invention is not limited to the foregoing embodiments. For instance, the present invention is also applicable to a multiple chip resistor including a single insulating substrate formed with a plurality of resistor films and a pair of terminal electrodes formed at the ends of each of the resistor films.

The specific structure of each part of the chip resistor according to the present invention may be varied in design in various ways without departing from the spirit of the invention.

The invention claimed is:

1. A chip resistor comprising: a chip-shaped insulating substrate; a pair of terminal electrodes formed on both ends of the insulating substrate; a plurality of resistor films formed on an obverse surface of the insulating substrate in parallel with each other between the paired terminal electrodes; and a cover coat formed on the obverse surface of the insulating substrate to cover the resistor films;

wherein one of the paired terminal electrodes comprises individual upper electrodes and a side electrode, each of the individual upper electrodes being formed on the obverse surface of the insulating substrate to be independently connected to a respective one of the resistor films, the side electrode being formed on a side surface of the insulating substrate to be connected to all the individual upper electrodes; and wherein the other one of the paired terminal electrodes comprises a common upper electrode formed on the obverse surface of the insulating substrate to be connected to all the resistor films and a side electrode formed on a side surface opposite from said side surface of the insulating substrate to be connected to the common upper electrode.

2. The chip resistor according to claim 1, further comprising auxiliary upper electrodes formed on the individual upper electrodes and the common upper electrode to cover the individual upper electrodes and the common upper electrode, wherein part of the auxiliary upper electrodes overlaps ends of the cover coat.

3. A method for manufacturing a chip resistor, the method comprising the steps of:

forming, on an obverse surface of an insulating substrate in the form of a chip, a plurality of resistor films in parallel with each other, individual upper electrodes each independently connected to a first end of a respective one of the resistor films and a common upper electrode commonly connected to respective second ends of the resistor films;

forming a trimming groove for resistance adjustment in each of the resistor films;

forming a cover coat for covering the resistor films on the obverse surface of the insulating substrate;

forming a side electrode on a side surface of the insulating substrate to be connected to all the individual upper electrodes; and forming a side electrode on a side surface opposite from said side surface of the insulating substrate to be connected to the common upper electrode.

4. The method for manufacturing a chip resistor according to claim 3, further comprising the step of forming, after the cover coat formation step, auxiliary upper electrodes on the individual upper electrodes and the common upper electrode to cover the individual upper electrodes and the common upper electrode so that part of the auxiliary upper electrodes overlaps ends of the cover coat.

* * * * *